US006766630B2

(12) United States Patent
Rutten

(10) Patent No.: US 6,766,630 B2
(45) Date of Patent: Jul. 27, 2004

(54) METHOD AND APPARATUS FOR UNWRAPPING STRETCH FILM FROM A STRETCH WRAPPED PALLETIZED LOAD

(76) Inventor: J. Bradley Rutten, 4385-92$^{nd}$ Cir. NE, Circle Pines, MN (US) 55014

( * ) Notice: Subject to any disclaimer, the term of this patent is extended or adjusted under 35 U.S.C. 154(b) by 0 days.

(21) Appl. No.: 10/369,785

(22) Filed: Feb. 18, 2003

(65) Prior Publication Data

US 2003/0177740 A1 Sep. 25, 2003

Related U.S. Application Data

(60) Provisional application No. 60/357,566, filed on Feb. 15, 2002.

(51) Int. Cl.[7] ..... B65B 43/26

(52) U.S. Cl. ..... 53/492; 53/381.2; 53/381.1; 242/527; 242/533; 414/412

(58) Field of Search ..... 53/492, 381.1, 53/381.2; 242/527, 533, 533.2, 526; 414/412

(56) References Cited

U.S. PATENT DOCUMENTS 5,148,651 A 9/1992 Masuda et al. ..... 53/381.2
5,282,346 A 2/1994 Masuda et al. ..... 53/118
5,463,841 A 11/1995 Hayakawa et al. ..... 53/381.2
5,725,349 A 3/1998 Garvey et al. ..... 414/412
5,727,747 A 3/1998 Hannen et al. ..... 242/527
5,911,666 A 6/1999 Lancaster, III et al. ..... 53/492

*Primary Examiner*—John Sipos
*Assistant Examiner*—Louis Huynh
(74) *Attorney, Agent, or Firm*—Fredrikson & Byron, P.A.

(57) ABSTRACT

An apparatus and a method for unwrapping stretch film from a palletized load. The unwrapping apparatus has two legs between which a load to be unwrapped is positioned, each leg including an upper and lower portion. Upper and lower grippers are attached to the upper and lower portions of each leg, respectively. The grippers are configured for engaging the stretch film and pulling it from the load. The unwrapping apparatus further includes a cutting unit including a cutting tool for cutting the stretch film. The cutting unit is preferably attached to one leg of the unwrapping apparatus. As the cutting unit moves vertically, preferably from a bottom position to a top position, the stretch film is pulled from the load by the grippers and a guide wheel and is cut by the cutting tool. Also provided is a spooler that may be used to spool and dispose of the collected, spooled stretch film.

19 Claims, 9 Drawing Sheets

METHOD AND APPARATUS FOR UNWRAPPING STRETCH FILM FROM A STRETCH WRAPPED PALLETIZED LOAD

This application claims the benefit of provisional application serial No. 60/357,566, filed Feb. 15, 2002.

FIELD OF INVENTION

This invention relates to an apparatus for cost-effectively unwrapping and disposing of stretch film, specifically for unwrapping a palletized shrink-wrapped load.

BACKGROUND

The most common method for removing stretch film from a pallet having a plurality of items stacked and stretch wrapped thereupon is to manually cut and remove the stretch film from the items. The manual cutting and removal of the stretch film is relatively time consuming, dangerous, and costly.

Apparatuses have been proposed to automatically remove stretch film or other wrapping from a load. U.S. Pat. No. 5,148,651 to Masuda (1992) discloses an apparatus designed to unwrap a palletized stretch-wrapped load while preventing the articles from falling off of the pallet. The Masuda apparatus includes first and second upright frames. The first upright frame includes two lower grippers and an elevated cutting unit. The second upright frame includes a carriage having a platen to press the top of the load and a pair of swing arms symmetrically arranged on either side of the platen and extending toward the first upright frame. Upper grippers are secured to the swing arms. In operation, the palletized and stretch-wrapped load is positioned between the first and the second upright frames. The platen is moved downwardly to press the top of the stretch-wrapped load. The lower grippers are operated to grip the stretchable film and separate a lower portion of the stretchable film from the load. The upper grippers grip the upper edge of the stretchable film and the cutting unit moved to a position near the top of the load, cuts the stretchable film. The lower grippers release the lower edge of the stretchable film and the upper grippers move upward. When the stretchable film is fully separated from the palletized load, a pusher is moved toward the rearward shifted stretchable film to push it into a collecting guide and discharge nip rollers may be driven. It is noted that the driving of many of the components is done through pneumatic cylinders.

U.S. Pat. No. 5,725,349 to Garvey (1998) discloses an apparatus designed to remove shrinkwrap from a plurality of bottles encased in the shrink-wrap and arranged in the form of a substantially rectangular package. The Garvey apparatus includes a base frame having an upper support surface with a first and a second cutting assembly extending upwardly through the upper support surface. A pusher is connected to the base frame and is adapted to move the package along the support surface over the first cutting assembly in order to effectuate a lengthwise cut in the bottom of the package. Likewise, a second pusher is secured to the base frame and is adapted to move the package across the support surface over the second cutting assembly to effectuate a widthwise cut in the bottom of the package. The Garvey shrink-wrap removing apparatus also includes a debagging station for removing the shrinkwrap from the plurality of bottles.

U.S. Pat. No. 5,911,666 to Lancaster (1999) discloses an apparatus for removing "plastic packaging material" from a wrapped load. A stream of air is applied to a region of the packaging material on the load at a sufficient temperature, volume, and velocity to cause the packaging material to be weakened for separation in the selected region. Generally, it is preferable to heat the stretch wrap packaging material to a temperature of at least about 170° F. Lancaster also discloses a turntable for removing the packaging material from the load. A mandrel assembly may be included to receive and collect the packaging material. The mandrel assembly may be used to wind up the packaging material to form a rolled bale, the bale being of about the height of the load or the height of the wrapped packaging material on the load. The Lancaster apparatus has several drawbacks. The hot air can damage or deform the plastic bottles contained on the palletized loads. The apparatus requires extensive energy consumption. Additionally, the Lancaster apparatus requires several additional parts, such as blowers, and poses a danger to workers. The turntable method of spinning the load to remove the stretch film makes it difficult to add the Lancaster to an existing conveyor system and would require several additional parts and would be expensive to retrofit. The Lancaster apparatus uses a large, complicated, and heavy mandrel mechanism to gather the stretch film and produces heavy, tall, and unstable "rolled bales" again making it more expensive to make and maintain and these bales are extremely dangerous to workers. Further, the Lancaster apparatus requires considerable floor space that in many cases makes it impractical to use.

SUMMARY OF THE INVENTION

The present invention provides a cost effective, low-maintenance, and ergonomic apparatus for removing stretch film from a pallet having a plurality of items, such as bottles, stacked thereupon.

The present invention includes an unwrapping apparatus for removing and disposing of stretch film or other wrapping from a plurality of articles palletized on a pallet. The apparatus includes a frame made up of at least two upright legs. The upright legs are operatively connected to maintain a space therebetween, the space being suitable for accommodating the palletized load. Two lower grippers, one connected to a lower portion of each leg, are included for engaging the film and pulling the film from the wrapped load. The lower grippers are movable toward and away from the load to effectuate the pulling of the film. Further included are two upper grippers, one connected to an upper portion of each leg, also configured for engaging the film and pulling the film from the wrapped load. The upper grippers are movable toward and away from the load. A cutting unit including a cutting tool for cutting the film is connected to one of the upright legs and is movable upward and downward, toward and away from the load. Further provided are a spooler unit, consisting of an integrated spooler and stripper units, and a pinch roller. The spooler unit is connected to one of the upright legs. The spooler unit maintains the proper tension of the film during the collection of the film and collects the film after it has been removed. The stripper unit removes the collected film from the spooler.

In operation, the unwrapping apparatus of present invention receives the load with the swing arms in an open or load pass position. When the load is positioned, for example via conveyor, for unwrapping, the two lower gripper arms are moved towards the load such that the gripper jaws protrude into the stretch wrap in such a manner as not to disturb the container lattice. The grippers preferably include jaws for effectuating such a protrusion. The lower grippers are actuated to grip the wrap. The lower grippers arms are then retracted to move the grippers away from the load, thereby pulling the wrap away from the load. The cutting unit is positioned at the bottom of the load and moved upwardly. The cutting tool engages the wrap for cutting as the cutting unit moves upwardly; the cutter unit is moved upwardly until it reaches the upper gripper height. Once the cutting unit has reached the upper gripper height, the upper gripper arms are actuated to move toward the load. The upper grippers engage and grip the wrap and the cutting unit completes the upward cutting of the wrap. With the wrap cut from bottom to top and the grippers gripping the wrap, the arms are actuated away from the load. The load is conveyed away with the wrap suspended by the grippers. All but one gripper release the wrap, the final gripper being actuated to continue its arc and threads the wrap through the pinch roller and spooler spindles. Once threaded, the spooler rotates to captivate the wrap, the final gripper is released and moved away, and the spooler continues to rotate, pulling the wrap through the pinch roller squeezing the air out of the wrap and is continually rotated until the entire wrap is spooled. The stripper is actuated to remove the spooled wrap from the spooler spindles. One of the upper grippers is used to knock the spooled wrap off of the stripper and into a bin.

The design of the apparatus makes it relatively inexpensive to produce and reduces the manufacturing cost of removing stretch film from a palletized load of bulk containers, such as bottles.

BRIEF DESCRIPTION OF THE DRAWINGS

The other objects and features of the present invention will become apparent from the following description of the preferred embodiments as a non-limiting examples, with reference to the accompanying drawings of the current preferred embodiment, in which.

DETAILED DESCRIPTION OF THE PREFERRED EMBODIMENT

Figure 1:
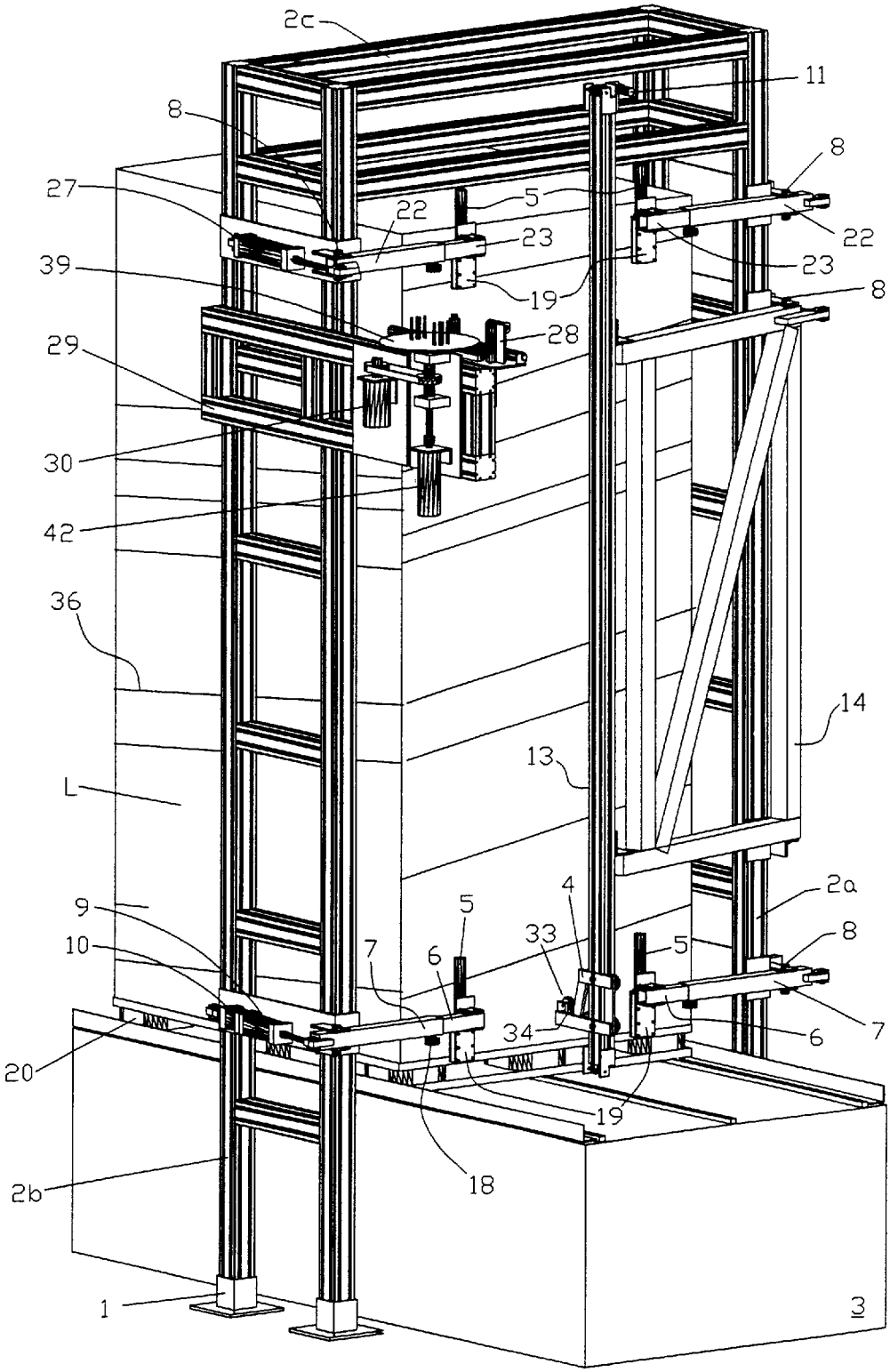
FIG. 1 is a rear perspective view of an unwrapping apparatus in accordance with one embodiment of the present invention.
Figure 2:
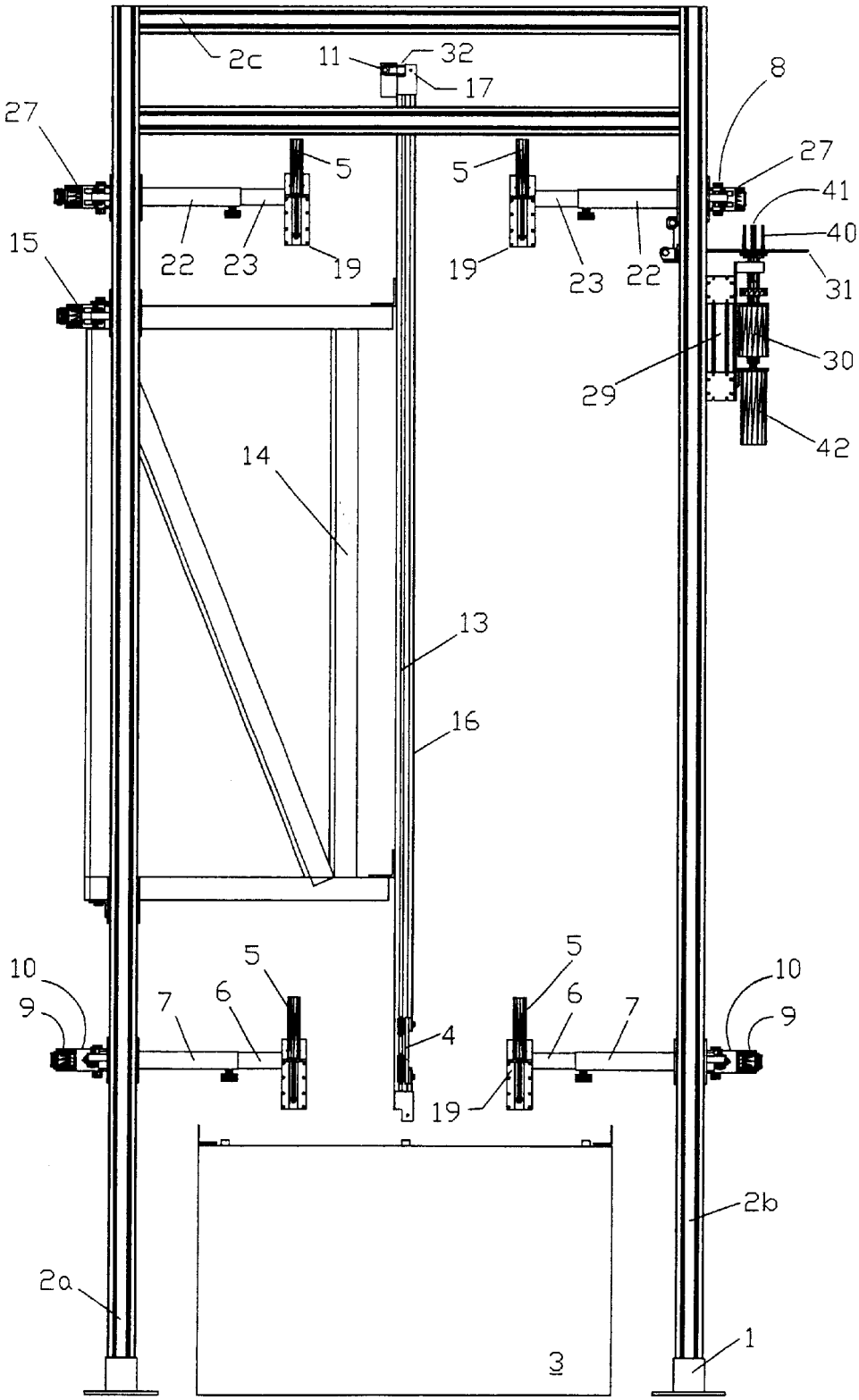
FIG. 2 is a front perspective view of the unwrapping apparatus of FIG. 1.

FIG. 1 is an overall elevational view of an unwrapping apparatus according to the present invention and FIG. 2 is an elevational side view from load L, engaging side. The unwrapping apparatus is configured to unwrap a palletized shrink, stretch, or plastic wrapped load L. Such a palletized and shrink-wrapped load L can be transported to a user such as a bottling plant, and unwrapped there. For the purposes of this description, left and right positions are referred to as from the perspective of the load L.

Referring to FIGS. 1 and 2, the unwrapping apparatus includes a frame having two legs 2*a* and 2*b* that are connected by a connecting brace 2*c*. The legs 2*a* and 2*b* are positioned to maintain a space therebetween, the space being suitable for accommodating the palletized load. A positioning element 3 moves the load L between the legs 2*a* and 2*b* and into a position to be unwrapped. In a preferred embodiment, the positioning element 3 is a conveyor. However, any other mechanism for positioning the load may be used. The conveyor 3 further removes the load L during and after unwrapping. In one embodiment, the apparatus is positioned with the legs 2*a* and 2*b* straddling a conveyor.

Figure 3A:
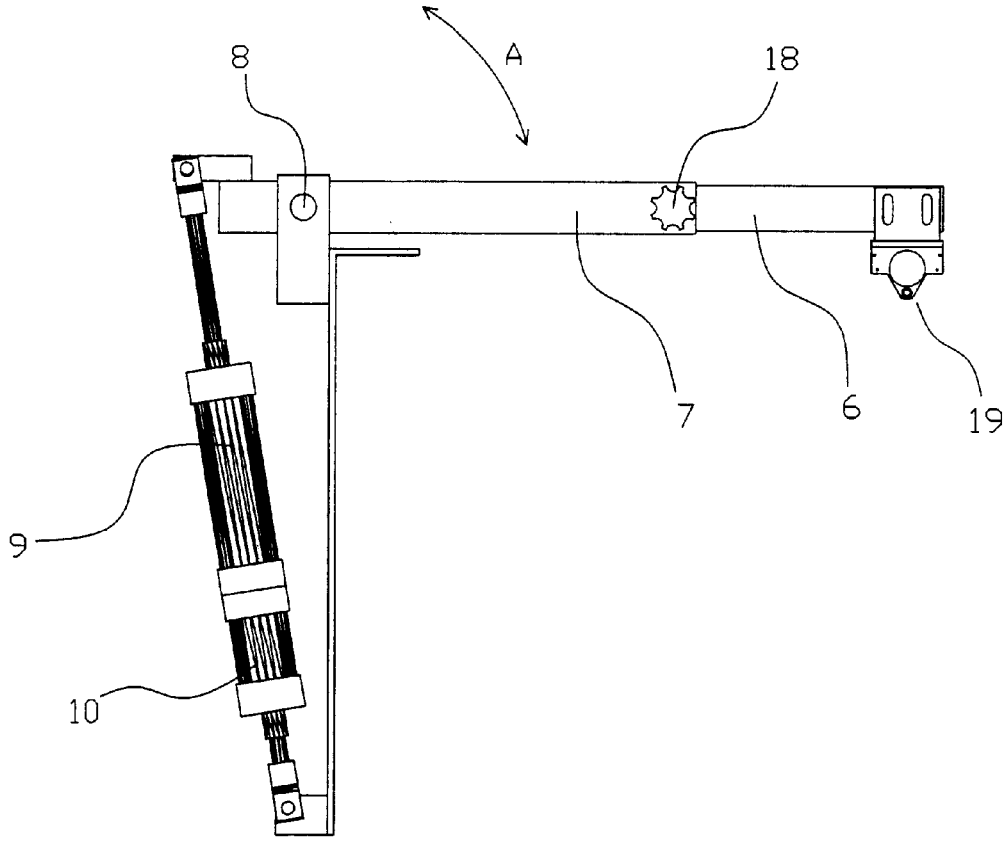
FIGS. 3A, 3B, and 3C are enlarged elevational and side views of lower gripper arms and grippers in accordance with an embodiment of the present invention.

FIGS. 1, 2, and 3A show a lower gripper arm that is attached to a lower portion of each leg 2*a* and 2*b*. Preferably, the lower gripper arm is composed of two parts: a male gripper arm 6 and a female gripper arm 7. The male gripper arm 6 and female gripper arm 7 are provided for adjustability along the front of the load of gripper 19. More or fewer parts may be included in the lower gripper arm as desired. A pair of cylinders 9, 10, controls each lower gripper arm. Cylinder 10 (short stroke) provides a stretching motion. Cylinder 9 (long stroke) provides movement towards and away from the load. The lower gripper arm may be attached to each leg by, for example, braces. However, any suitable attachment may be used. The stretch film 36 surrounding the load L is engaged by the grippers 19 using the arms and cylinders described above.

Similarly, an upper gripper arm is attached to an upper portion of each leg 2*a* and 2*b*. Preferably, the upper gripper arm is composed of two parts: a female gripper arm 22 and a male gripper arm 23. The upper gripper arm movement is controlled in a manner similar to that of the lower gripper arm, except only a single cylinder 27 is used to control the movement of the upper gripper arms. The attachment of the upper arm's cylinder 27 to the apparatus may be achieved by any suitable attachment. Optionally, the attachment may be the same as that of the lower gripper arm's cylinder 9 and 10 to the apparatus. The cylinder 27 engages the arm 22 in a substantially similar manner to that of the lower gripper assembly. A gripper 19 is attached to the free end of male arm 23. The upper grippers 19 are moved towards and away from the load L by using the cylinder 27.

While preferred embodiments of the gripper arms are herein described, it should be understood that any suitable configuration of upper and lower gripper arms to effectuate gripping of the stretch wrap may be used.

Figure 3B:
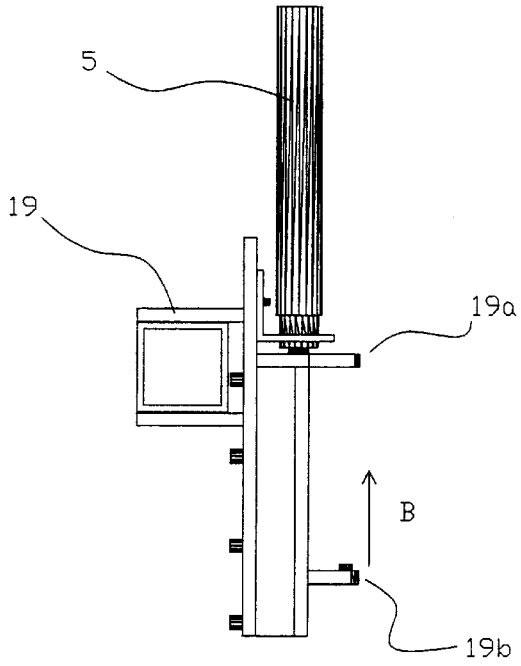
Figure 3C:
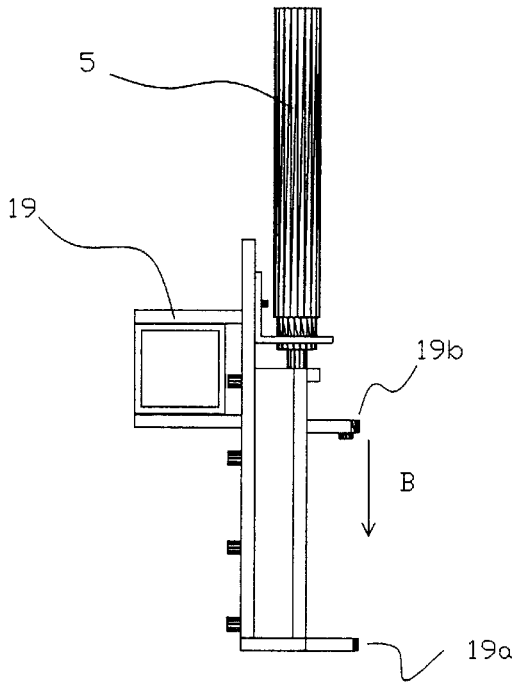

Referring to FIGS. 3A, 3B, and 3C, the upper and lower grippers 19 are moved towards the load L such that they engage the stretch film 36 by protruding into the stretch film 36. The grippers 19 function by maintaining one of the upper or lower jaw stationary and moving the other jaw to the stationary jaw. The grippers 19 may be used to grip or release the stretch film by moving either jaw 19 A or B towards or away from the other jaw 19 A or B with a pneumatic cylinder 5 or other suitable device. In one embodiment, the grippers include a socket headed cap screw in the moving jaw and a mating hole in the stationery jaw, the screw head mating with the hole to effect a bite. In order to pull the stretch film 36 away from the load L and into a position suitable for cutting with the cutter trolley 4, the lower grippers 19 pull the wrap up and away from the load L. The movement of the lower grippers 19 being controlled by the lower arm stretch cylinder 10.

Figure 4A:
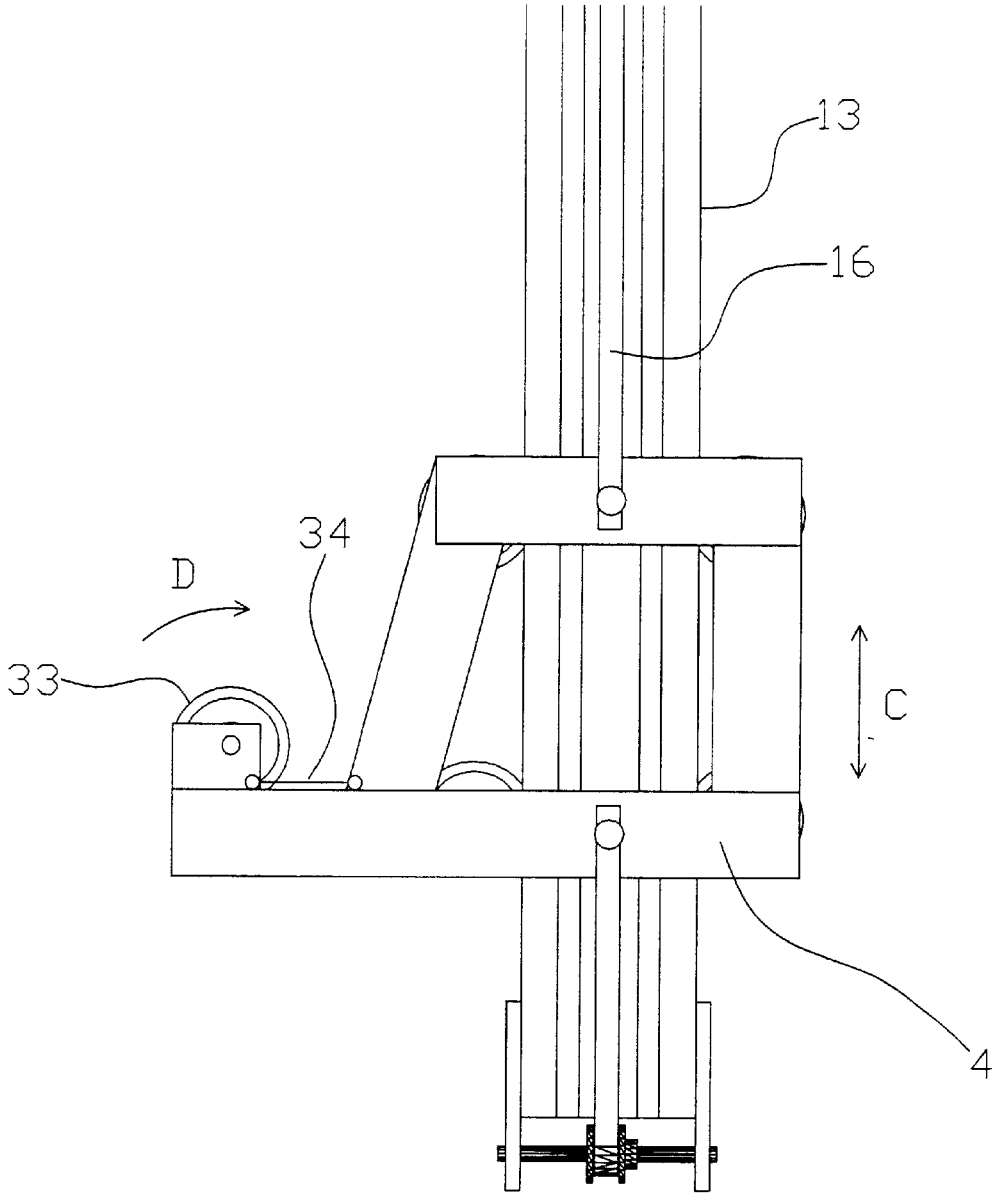
FIGS. 4A and 4B are enlarged side views of a cutting unit in accordance with an embodiment of the present invention.

Referring to FIGS. 1, 2, and 4A, the cutting unit includes several components connected to the apparatus by a cutter swing arm 14, the cutter swing arm 14 being attached to the left leg 2*a*. Optionally, the cutter swing arm 14 may be attached to the right leg 2*b*. In one embodiment, the cutter swing arm 14 is attached to either leg 2*a* or 2*b* via brackets and a linear or pivotal component, such as a bearing, in a manner that allows the cutter swing arm 14 to move freely towards and away from the load L. However, any suitable device may be used to position the cutter swing arm as long as it can move freely towards and away from the load L. A cylinder 15, or other suitable control component, is used to control the movement of the cutter swing arm 14 as desired.

As shown in FIG. 4A, the cutter trolley 4 is connected to the apparatus via cutter slide-bar 13. The cutter trolley 4 includes a cutting tool 34 for cutting the stretch film 36. In a preferred embodiment, the cutting tool is a hot knife assembly. The cutter swing arm 14 (see FIG. 1) is used to position the cutter trolley 4 for cutting the stretch film 36. When the load L is in position and the stretch film 36 has been pulled away from the load L by the lower grippers 19, the cutter trolley 4 cuts the stretch film 36. While a preferred embodiment cuts the stretch film 36 from the bottom of the load L to the top of the load L, the stretch film 36 may be cut from the load L along any other suitable axis.

Figure 4B:
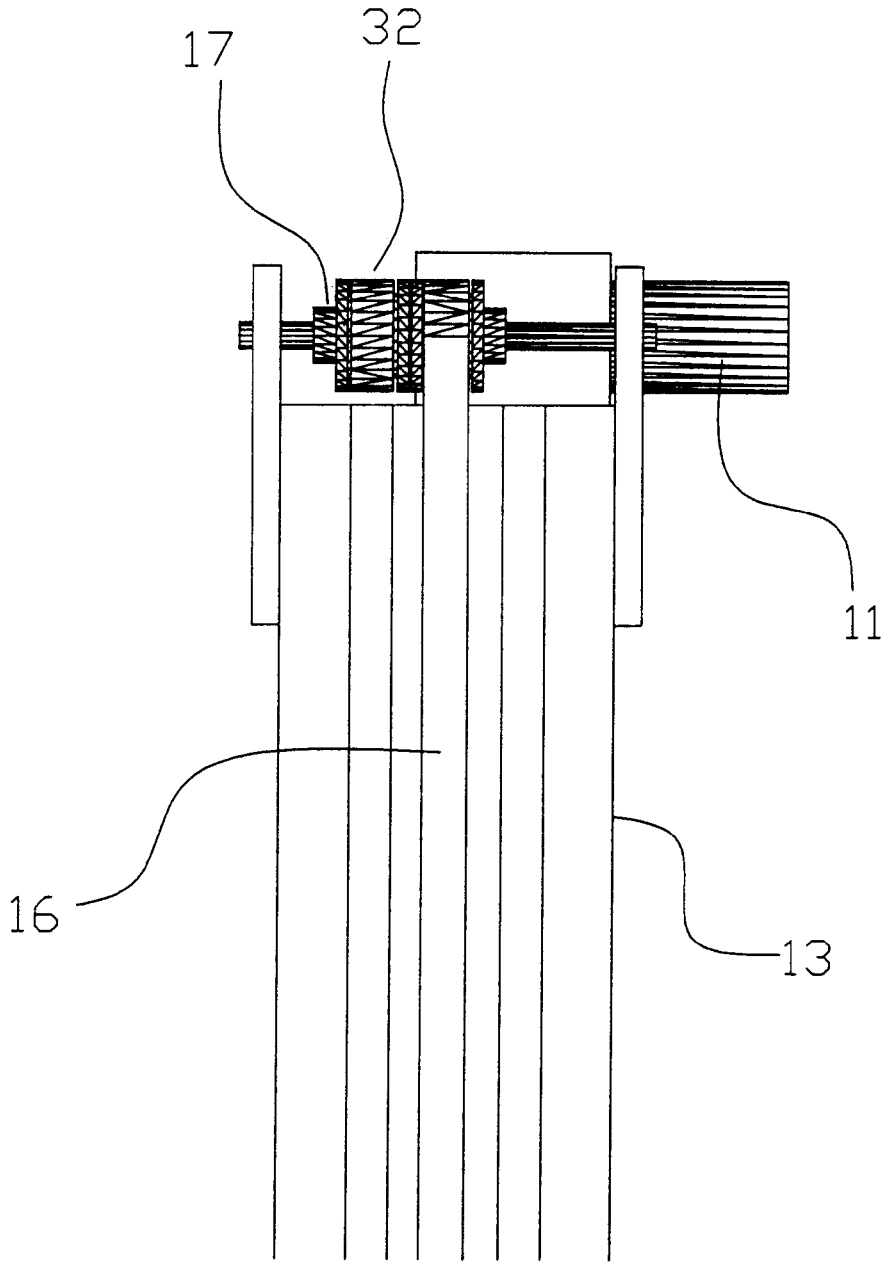

FIG. 4B illustrates an embodiment wherein a motor 11 and cutter trolley belt 16 drive the trolley along the cutter slide bar 13, via drive belt 32, thus effectuating a vertical cut along the length of the stretch film 36. Any other method of driving the trolley, for example, linear actuator or manually, may alternately be used.

Referring again to FIGS. 1 and 4A, both lower grippers engage the wrap and pull the wrap away from the load in such a matter as to position the guide wheel 33 behind the wrap and cutting tool 34 in front of the wrap. The cutter trolley 4 is moved upwardly along the cutter slide-bar 13, and the engaged wrap turns a guide wheel 33 which in turn pulls the stretch film 36 away from the load L and into the cutter trolley 4 for cutting by the cutting tool 34, for example, a hot knife. When the cutting trolley 4 reaches the same height as the upper grippers 19, the upper grippers 19 are moved towards the load L using the upper arm cylinder 27 to engage the stretch film 36 that has been pulled away from the load L by the guide wheel 33. After the upper grippers grip the plastic, the remaining stretch film 36 is cut by moving the cutting trolley 4 and cutting tool 34 upwardly to and through the top of the stretch film 36. Once the stretch film has been cut, the grippers 19 and slide-bar swing arm 14 are moved away from the load L. The load is then moved from its position and all but one of the grippers 19 release the stretch film 36. In a preferred embodiment, one of the upper gripper 19 maintains its grip on the stretch film 36 until it is fed into the spooler.

Figure 5A:
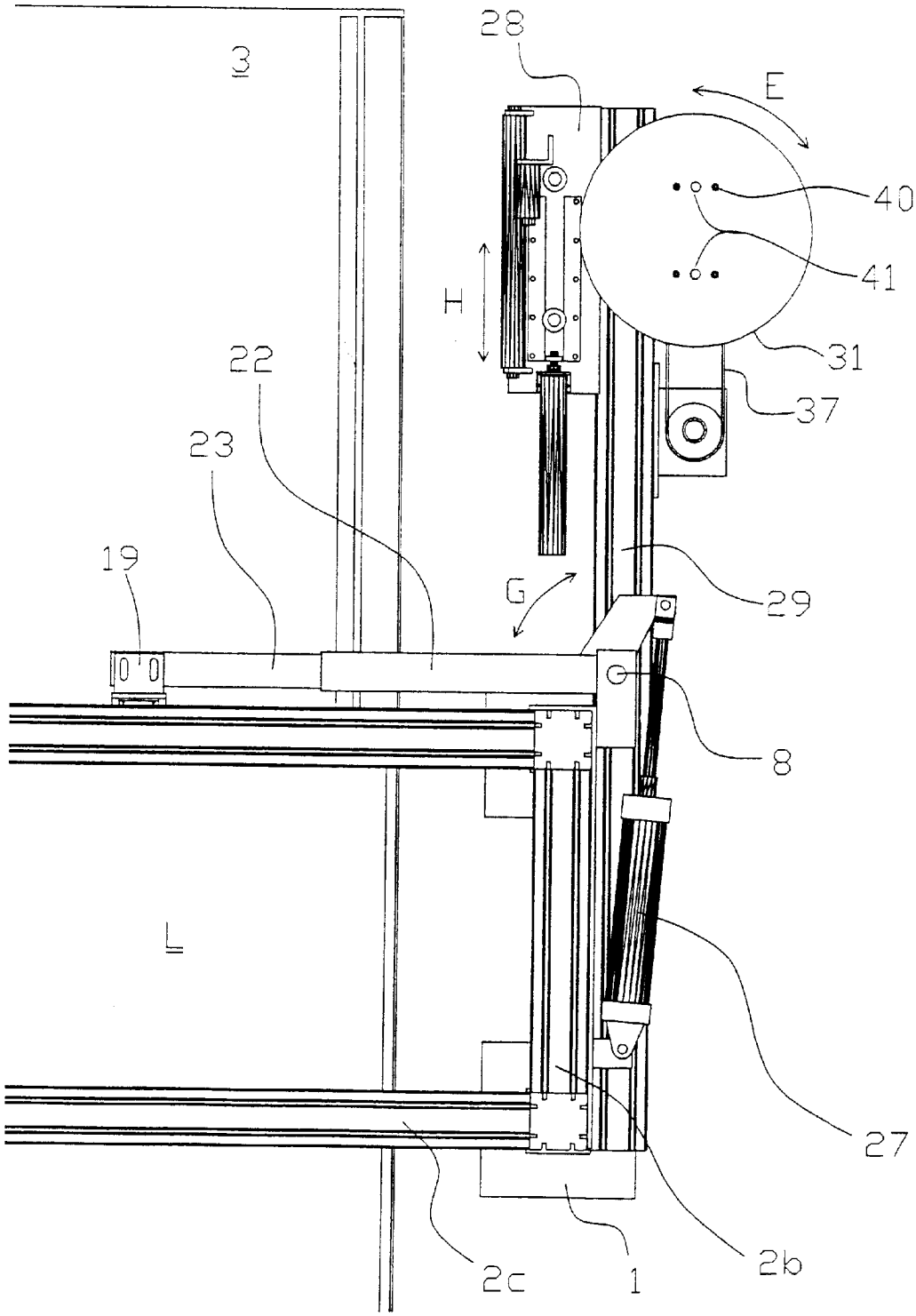
FIG. 5A is a top view of the upper gripper arm, the pinch roller unit, and the spooling unit.
Figure 6A:
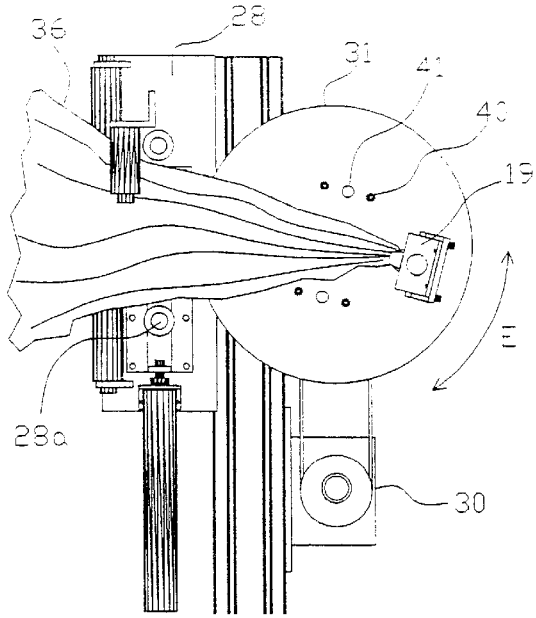
FIGS. 6A, 6B, 6C, and 6D are top views of the spooler unit and the pinch roller unit operations.
Figure 6B:
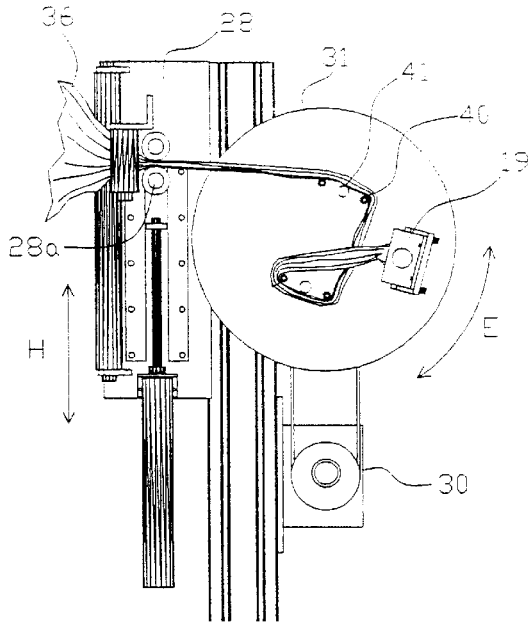
Figure 6C:
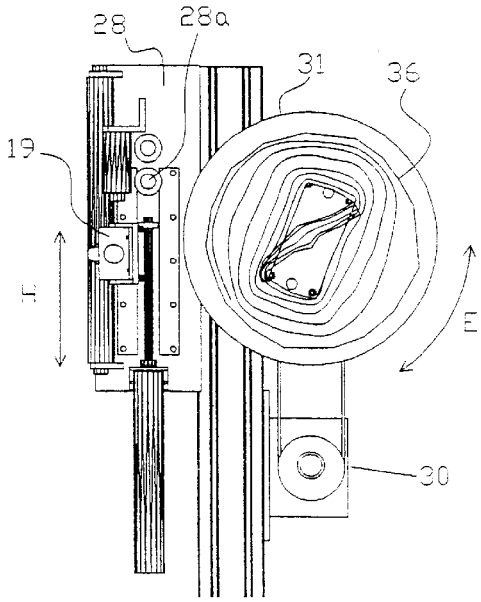
Figure 6D:
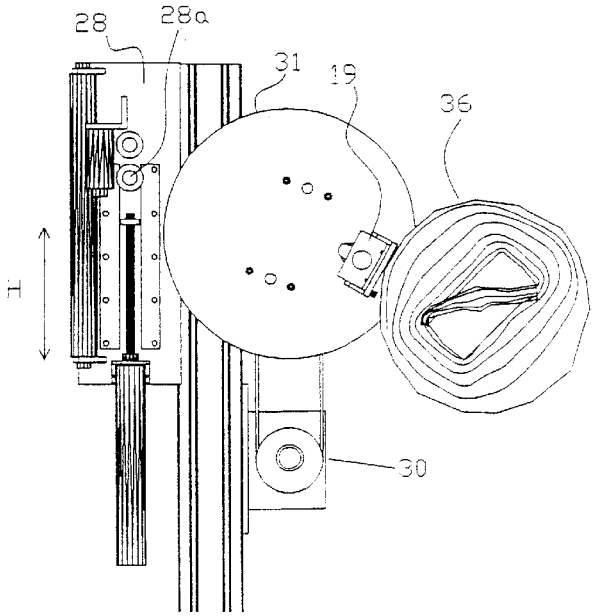
Figure 7A:
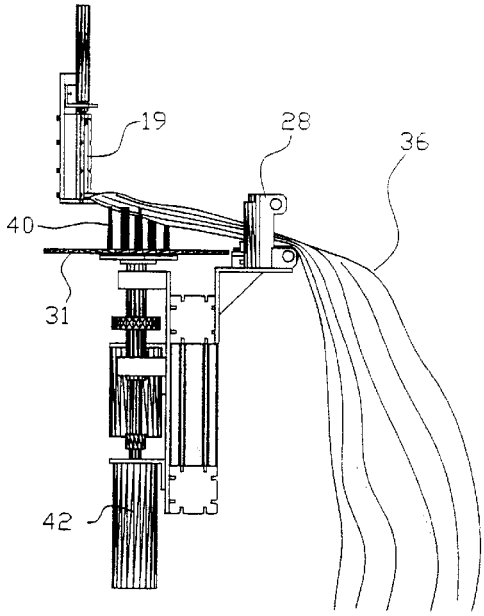
FIGS. 7A, 7B, 7C, 7D, are and 7E side views of the spooler unit and the pinch roller unit operations and the disposal of the bundled wrap by the gripper arm.
Figure 7B:
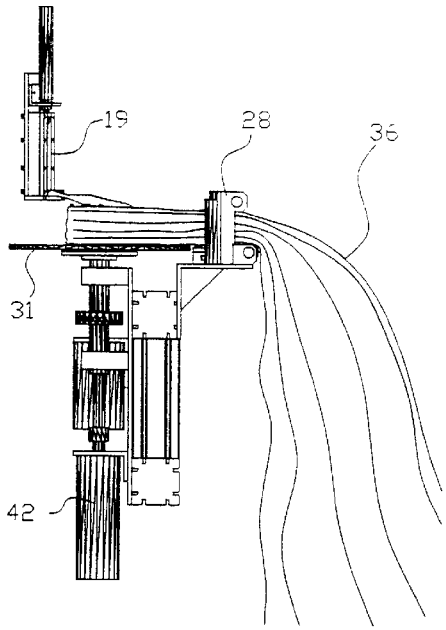
Figure 7C:
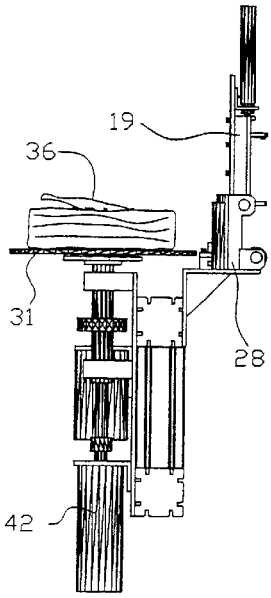
Figure 7D:
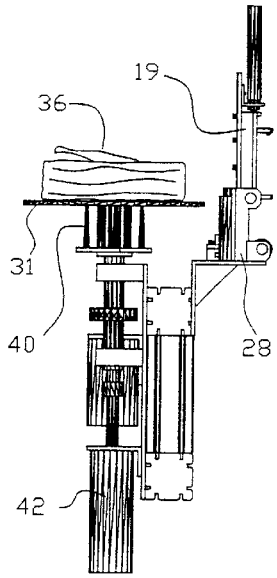
Figure 7E:
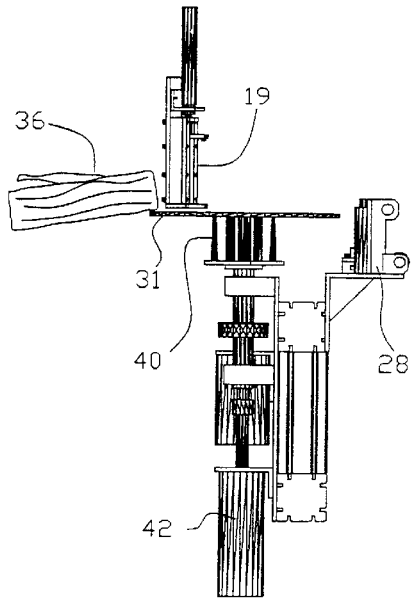

Referring to FIGS. 5, 6A and 6B, the stretch film 36 is threaded across a pinch roller 28 into the spooler unit 39 by the upper right gripper 19. A tube guide or a roller guide maybe used instead of a pinch roller. A cylinder 27, or other suitable device, controls the position of the upper arm 22, 23. The pinch roller 28 is configured to contain and align the stretch wrap into the spooler while it rotates. The spooler unit 39 and the pinch roller 28 are connected to the right leg 2*b* by the spooler support arm 29. The spooler unit 39 is comprised of at least one spooler spindles 40, however four spooler spindles 40 are preferred. The spooler spindles 40 are rotated by spooler drive belt 37 which is, in turn, powered by a spooler motor 30. When the stretch film 36 has been threaded through the pinch roller 28 onto the spooler spindles 40, the spindles are rotated by the spooler drive belt 37 to captivate the stretch film 36 to the spooler spindles 40. Once the stretch film 36 has been captivated, the final gripper 19, preferably the upper right gripper or the upper left gripper, releases the stretch film 36 and the spooler spindles 40 are rotated via the spooler motor 30 until all of the stretch film 36 has been spooled.

Referring to FIGS. 6A, 7C, 7D, and 7E, the stripper cylinder 42 is actuated to move the stripper 31 upward along the stripper guides 41 to strip the spooled wrap 36 off of the spooler spindles 40. The gripper 19 which has maintained the hold on stretch film 36 is extended towards the spooler bundle and pushes the bundle into a bin for disposal. In one embodiment, the stripper unit comprises a flat plate having at least one bore therein for receiving one of the spooler spindles. The flat plate is configured for up and down movement such that the flat plate may be slid over one of the spindles to separate the collected film from the spindle.

It is noted that any other mechanism for spooling and disposing the film in keeping with the present invention may alternately be used.

Thus, in summary, in a preferred embodiment, the present invention operates as follows. The unwrapping apparatus receives the load with the swing arms in an open or load pass position. When the load is positioned, for example via conveyor, for unwrapping, the two lower gripper arms are moved towards the load such that the gripper jaws protrude into the stretch wrap. The gripper cylinders are actuated to grip the wrap and the short cylinders on the lower arms are retracted to move the grippers away from the load, thereby pulling the wrap away from the load. The cutter swing arm is actuated to position the cutter trolley at the bottom of the load. The cutter trolley motor is activated to move the cutter trolley upward. The guide wheel and hot knife engage the wrap for cutting as the cutter trolley moves upward; the trolley moving upward until it reaches the upper gripper height. At this time, the upper grippers are actuated to move toward the load and engage and grip the wrap. The cutter trolley then completes the upward cutting of the wrap. With the wrap cut from bottom to top, each of the arms is actuated away from the load thus opening the door for the load. The load is conveyed away with the wrap suspended by the grippers. All but of the grippers, preferably one of the upper grippers, release the wrap, the final gripper being actuated to continue its arc, threading the wrap through pinch roller and the spooler spindles. Once threaded, the spooler captivates the wrap and the final gripper is released and retracts. The spooler rotates until the entire wrap is spooled. The stripper strips the collected, spooled wrap off of the spindles disposes of the wrap into a waiting an appropriate container. In one embodiment, a gripper is used to knock the spooled wrap into a bin for disposal.

The present invention may be embodied in other specific forms without departing from the spirit or essential attributes thereof and accordingly reference should be made to the appended claims rather than to the foregoing specification as indicating the scope of the invention.

What is claimed is:

1. An unwrapping apparatus for removing stretch film from a stretch wrapped, palletized load, the unwrapping apparatus comprising:

a frame having at least two upright legs operatively connected to maintain a space therebetween, the space being suitable for accommodating the palletized load, each of the upright legs including a lower portion and an upper portion;

two lower grippers configured for engaging the film and pulling the film from the wrapped load, one lower gripper being connected to the lower portion of each upright leg, each of the lower grippers being movable toward and away from the load;

two upper grippers configured for engaging the film and pulling the film from the wrapped load, one upper gripper being connected to the upper portion of each upright leg, each of the upper grippers being movable toward and away from the load; and a cutting unit including a cutting tool for cutting the film, the cutting unit being carried by a movable upright leg and being movable upward and downward and toward and away from the load;

a spooler carried by the frame for collecting the film after the film has been cut by the cutting unit.

2. The unwrapping apparatus of claim 1, further including a pinch roller to contain and align the stretch wrap into the spooler.

3. The unwrapping apparatus of claim 1, further including one of a tube guide or a roller guide to contain and align the stretch wrap into the spooler.

4. The unwrapping apparatus of claim 1, further including a stripper unit to remove the collected film from the spooler.

5. The unwrapping apparatus of claim 4, wherein the stripper unit is configured to dispose of the collected film into an appropriate container.

6. The unwrapping apparatus of claim 1, wherein the spooler is connected to the upright leg opposite the cutting unit.

7. The unwrapping apparatus of claim 1, wherein the cutting tool is a hot knife.

8. The unwrapping apparatus of claim 1, wherein the spooler further comprises a tube guide to maintain tension of the film during spooling.

9. The unwrapping apparatus of claim 1, wherein the spooler further comprises a series of one or more rollers to maintain tension of the film and to contain and align the stretch wrap into the spooler during spooling.

10. The unwrapping apparatus of claim 1, wherein the spooler further comprises one or more spindles configured for engaging the film to collect the film.

11. The unwrapping apparatus of claim 10, further including a stripper unit to remove the collected film from the spooler, wherein the stripper unit further comprises a flat plate having at least one bore therein for receiving a spindle, wherein the flat plate is configured for up and down movement such that the plate may slide over the spindle to separate collected film from the spindle.

12. The unwrapping apparatus of claim 1, wherein the spooler further comprises a plurality of spindles configured for movement in a circular fashion to collect the film.

13. The unwrapping apparatus of claim 1, wherein the spooler further comprises a plurality of spindles configured for mechanical rotation to collect the film.

14. The unwrapping apparatus of claim 1, wherein the spooler comprises a roller guide for maintaining a tension of the stretch film and a plurality of spindles configured for engaging the film to collect the film.

15. The unwrapping apparatus of claim 1, further including a positioning device for positioning a film wrapped load in the space between the two upright legs for the load to be unwrapped.

16. The unwrapping apparatus of claim 15, wherein the positioning device is configured to remove the load from the space between the two upright legs after the load is unwrapped.

17. The unwrapping apparatus of claim 16, wherein the positioning device is a conveyor.

18. A method for removing the stretch film from a stretch wrapped, palletized load, the method comprising the steps of:

providing an unwrapping apparatus including two legs, one leg positioned on either side of a positioning device, the legs having upper and lower portions, an upper gripper being attached to each upper portion and a lower gripper being attached to each lower portion, and a cutting unit having a cutting device attached to one leg for vertical movement thereon;

positioning a stretch wrapped load on the positioning device, between the two legs;

actuating the lower gripper arms to engage the stretch film;

retracting the lower gripper arms to pull the stretch film from the load;

moving the cutting device to engage with the stretch film at a lower position and moving the cutting unit upwardly to an upper position, cutting the stretch film with the cutting device as the cutting unit is moved;

engaging the stretch film with the upper grippers;

cutting a remainder of the stretch film with the cutting device; and removing the stretch film from the load.

19. The method of claim 18, further including the step of providing a spooler, wherein the step of removing the stretch film from the load includes spooling the film with the spooler and removing the spooled film.

* * * * *